US005758250A

United States Patent [19]

Miki

[11] Patent Number: 5,758,250

[45] Date of Patent: May 26, 1998

[54] PAPER FEEDING DEVICE AND METHOD

[75] Inventor: Katsuhiko Miki, Ichikawa, Japan

[73] Assignee: Ricoh Company, Ltd., Tokyo, Japan

[21] Appl. No.: 706,834

[22] Filed: Sep. 3, 1996

[30] Foreign Application Priority Data

Sep. 1, 1995 [JP] Japan ..... 7-225252

[51] Int. Cl.[6] ..... G03G 15/00

[52] U.S. Cl. ..... 399/393; 271/160

[58] Field of Search ..... 399/393; 271/121, 271/127, 160

[56] References Cited

U.S. PATENT DOCUMENTS

| | | | |
|---|---|---|---|
| Re. 35,341 | 10/1996 | Kikuchi et al. | 271/127 X |
| 4,505,571 | 3/1985 | Kimura et al. | 399/393 |
| 5,002,266 | 3/1991 | Kikuchi et al. | 271/127 X |
| 5,053,814 | 10/1991 | Takano et al. | 399/66 |
| 5,136,339 | 8/1992 | Morita et al. | 399/112 |
| 5,221,951 | 6/1993 | Sakamoto | 399/393 |
| 5,253,015 | 10/1993 | Morita et al. | 399/13 |
| 5,443,252 | 8/1995 | Morinaga et al. | 271/127 |
| 5,632,477 | 5/1997 | Morinaga | 271/127 |
| 5,634,188 | 5/1997 | Johnston et al. | 399/393 |

FOREIGN PATENT DOCUMENTS 5-97253 4/1993 Japan .

OTHER PUBLICATIONS

Abstract of Japanese Published Patent 04–125230, Ikeda et al., published Apr. 24, 1992.

*Primary Examiner*—Matthew S. Smith

*Attorney, Agent, or Firm*—Oblon, Spivak, McClelland, Maier & Neustadt, P.C.

[57] ABSTRACT

A paper sheet feeding device in which paper sheets are supplied from above includes a bottom plate for accommodating paper sheets and springs which lift up the bottom plate. The springs are released in response to the removal of the paper sheet feeding device from the image forming apparatus so that the bottom plate assumes a position determined by the weight of the paper sheets thereon.

10 Claims, 1 Drawing Sheet

PAPER FEEDING DEVICE AND METHOD

BACKGROUND OF THE INVENTION

1. Field of the Invention

The invention relates to a paper feeding device or apparatus and method for adding paper thereto, particularly in an image forming apparatus such as a copying machine, facsimile machine, printer or printing press in which a paper tray or paper cassette is used.

This application is based on Japanese Patent Application JP 7-225252, filed with the Japanese Patent Office on Sep. 1, 1995, the entire contents of which are hereby incorporated by reference.

2. Description of the Related Art

There have been various types of paper feeding devices provided in an image forming apparatus. In general, paper feeding trays or cassettes in which a paper accommodating portion is formed have been used. As this type of paper feeding apparatus, a paper accommodating cassette is disclosed in Japanese Laid Open Patent 05-97253. In the paper accommodating cassette, paper sheets are caused to engage corner claws by automatically moving an end fence (end plate) back and forth according to the quantity of paper. In particular, when a bottom plate of the cassette is located at its lowest position, the end fence moves back, and when at its highest position, the fence moves forward and causes alignment of the leading edges of the paper sheets. Thus, in the prior art, the movement of the end fence aligns the paper sheets.

As the possible number of paper sheets to be accommodated increases (e.g., 500 paper sheets) the thickness of the stack of paper sheets to be accommodated becomes greater and the distance from the top sheet of the stack to the bottom plate at its lowest position is greater, so that the lower part of the paper sheets may not be set tidily. Therefore, paper jams or double paper feedings occur and increase the operator burden.

However, when using inexpensive corner claws, it is impossible to separate paper sheets accumulated in the paper sheet feeding cassette unless corners of the leading edges of the paper sheets engage the corner claws. Therefore, it is important to align the leading edges of paper sheets accumulated in the paper sheet feeding cassette.

The alignment of the leading edges of the paper sheets is accomplished by pushing the paper sheets toward a paper feeding direction using an end fence. But if a bottom plate is constructed so as to rotate about its end as a journal, the number of possible accommodated paper sheets is big and the length of the bottom plate is short, the rotational angle is big. Then, as the number of the paper sheets decreases, the leading edges of the paper sheets can get out from the corner claws unless the paper sheets are pushed by the end fence much more than when the cassette is fully loaded with paper sheets.

The bottom plate is rotated and located at the highest position when the number of the paper sheets in the cassette is small, thereby the end fence is set to then push paper sheets and engage the corner claws correctly.

Since the end fence is set to push the paper sheets and engage the corner claws correctly according to the quantity of paper, when the bottom plate moves down to its lowest position upon loading paper sheets in the cassette, the end fence pushes the paper sheets too much and causes buckling of the paper sheets. Thereby, the added paper sheets are put on the buckled paper sheets in the cassette. This is difficult to do and unfitted portions occur on the boundary between the added paper sheets and the buckling paper in the cassette. The unfitted portions easily cause misfeedings such as double paper sheet feedings, non-feedings or paper jams.

The defect of the prior art will be explained with reference to FIG. 3 which shows a cross sectional view of a conventional paper sheet feeding cassette. In FIG. 3, the paper sheet feeding tray 1 basically comprises a paper accommodating portion 2, a bottom plate 3 which is rotatably supported by a supporting portion 3*a*, corner claws 5 which engage corner portions of paper sheets 4 and are located at the leading end in a paper feeding direction, an end fence 6 which controls the position of the ends of the paper sheets in the paper feeding direction and a plate spring 7 which pushes on the ends of the paper sheets in the feeding direction. Further, on the rear surface and a side surface of the paper accumulating portions are bottom plate lifting-up mechanisms 8. A paper sheet feeding roller 9 is provided in an image forming apparatus (e.g. a copying machine).

In the paper sheet feeding apparatus, when adding paper sheets when the number of paper sheets on the paper accommodating portion 2 becomes small, since the bottom plate 3 moves down and the plate spring 7 does not push back according to the quantity of paper sheets on the paper accommodating portion 2, the distance between the plate spring 7 and the corner claws 5 gets shorter than in case paper sheets are fully accumulated on the paper accumulated portion 2.

As shown in FIG. 3, the paper sheets are buckling. If in that situation, paper sheets are added, unfitted portions occur between the remaining paper sheets and the added paper sheets.

SUMMARY OF THE INVENTION

It is an object of the present invention to overcome the above and other problems encountered in the aforementioned art.

It is another object of the present invention to provide a paper sheet feeding apparatus capable of preventing unfitted paper sheets.

It is a further object of the present invention to provide a paper sheet feeding apparatus which is capable of preventing paper sheets from misfeeding.

It is yet a further object of the present invention to provide a method of adding paper sheets to a paper sheet feeding apparatus.

According to one feature of the invention, a paper sheet feeding device for receiving paper sheets from above in an image forming apparatus comprises a bottom plate for supporting paper sheets; lifting-up means for lifting up said bottom plate; and releasing means for at least partially releasing said lifting-up means in response to initiation of a paper feeding operation such that the bottom plate assumes a position determined by the weight of the paper sheets thereon, whereby the bottom plate assumes a desired position during a paper adding operation.

According to another feature of the invention, a paper sheet feeding device for receiving paper sheets from above in an image forming apparatus comprises a bottom plate for supporting paper sheets; bottom plate lifting-up mechanism comprising a pressing arm in contact with said bottom plate, a pressing lever driving said pressing arm, and a pulling spring elastically urging said pressing lever; and a pressure releasing arm operative in response to initiation of a paper feeding operation such that the bottom plate assumes a position determined by the weight of the paper sheets thereon.

According to another feature of the invention, an image forming apparatus comprises an image forming device; and a paper sheet feeding device in which paper sheets are supplied from above, the paper sheet feeding device comprising a bottom plate for accommodating paper sheets, lifting-up means for lifting up said bottom plate, and releasing means for at least partially releasing said lifting-up means in response to initiation of a paper feeding operation such that the bottom plate assumes a position determined by the weight of the paper sheets thereon, whereby the bottom plate assumes a desired position during a paper adding operation.

According to another feature of the invention, a method of adding paper sheets to a paper sheet feeding device in an image forming apparatus, the paper sheet feeding device having a bottom plate which lifts the paper sheets for feeding, comprises the steps of drawing the paper sheet feeding apparatus out of the image forming apparatus; at least partially releasing the lifting of the paper sheets by the bottom plate in response to said drawing step, such that said bottom plate assumes a position based on the weight of the paper sheets thereon; and adding paper sheets to said paper sheet feeding device.

BRIEF DESCRIPTION OF THE DRAWINGS

Other objects and further features of the present invention will become apparent from the following detailed description, particularly when read in conjunction with the accompanying drawings, wherein.

DESCRIPTION OF THE PREFERRED EMBODIMENT

Figure 3:
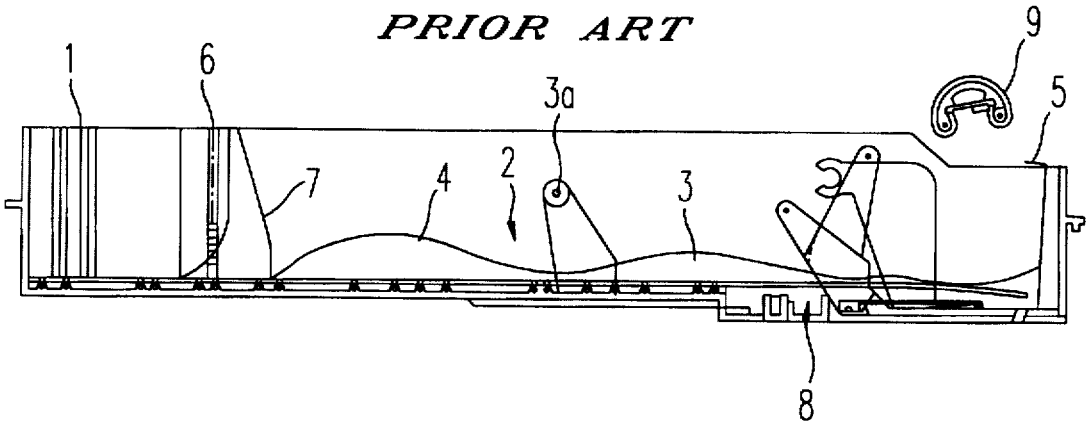
FIG. 3 PRIOR ART
FIG. 3 is a cross sectional view of a conventional paper feeding tray where paper sheets are going to be added.

In the following description, explanations of the same structures as in the conventional paper sheet feeding tray as shown in FIG. 3 will be omitted, and the same numbers as in the conventional tray are used on the corresponding elements.

Figure 1:
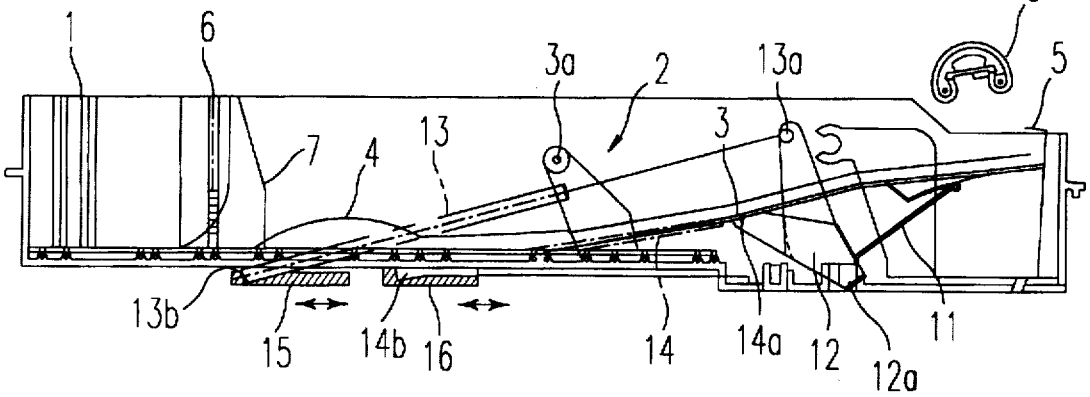
FIG. 1 is a cross sectional view showing a paper sheet feeding tray is positioned for receiving paper sheets.

As shown in FIG. 1, in a paper sheet feeding tray, a pressing arm 11 lifts up a bottom plate 3 and a pressing lever 12 drives the pressing arm 11. One end of the pressing arm 11 is rotatably mounted on a journal 12*a* so that upon its rotation the other end of the pressing arm 11 in contact with the bottom plate 3 lifts up or moves down the bottom plate 3.

The journal 12*a* is on the pressing lever so that pivoting of the pressing lever 12 causes the rotation of the pressing arm 11. The journal 12*a* has two lever portions extending in an approximately V-shape and is respectively urged in a counter-clockwise direction by first and second pulling springs 13, 14. The first and second pulling springs 13, 14 thereby urge the pressing lever to pivot in a direction which rotates the pressing arm to lift the bottom plate. That is, the bottom plate 3 is elastically urged to rotate counterclockwise about the supporting portion 3*a* as a journal by the pulling springs 13, 14 via the pressing lever 12 and the pressing arm 11.

It is also possible to construct the pressing lever 12 with one pulling spring and one lever portion.

Top ends of the lever portions are engaged by ends 13*a*, 14*a* of the pulling springs 13, 14. The other ends 13*b*, 14*b* of the pulling springs 13, 14 are respectively engaged in pressure releasing arms 15, 16. If the pressure releasing arms 15, 16 move to the right in the figure, the tension on the pulling springs is released and the pressing lever and pressing arm permit the bottom plate to rotate clockwise and move downward.

The bottom plate lifting-up mechanism 8 is made up of the pressing arm 11, the pressing lever 12 and the pulling springs 13, 14. The pressure releasing arms 15, 16 are constructed to be moved in the right direction in the figures by a mechanism (not shown) when the paper sheet feeding tray 1 is drawn out from the main body of the image forming apparatus in the right direction of the figures, thereby to release the force urging the pulling springs 13, 14 and to release the lifting force on the bottom plate 13.

When supplying paper sheets, when the lifting force of the bottom plate lifting up mechanism is released by movement of the pressure releasing arms 15, 16 and the paper sheet pushing force to the feeding roller 9 is thus released, the bottom plate 3 rotates clockwise from the position shown in FIG. 1 until the weight of remaining paper sheets on the bottom plate 3 and the remaining elastic force of the pulling springs 13, 14 balance. Additional paper sheets may then be added to cause the bottom plate 3 to be further lowered.

It is possible to set the position where the bottom plate 3 stops due to the release of the lifting up mechanism by adjusting the elastic force of the pulling spring 13, 14. The adjustment is achieved by selecting the spring coefficient of the pulling spring 13, 14 or by changing the engaging positions of the pulling spring 13, 14 on the pressure releasing arms 15, 16 (setting means). These adjustments and changes are performed at shipping time or at maintenance time by a service person.

Upon again inserting the paper feeding tray 1 into the image forming apparatus, the pressure releasing arms 15, 16 move in the left direction of the figures by the non-illustrated mechanism, and the elastic force of the pulling springs 13, 14 pivots the lever 12 to the left. The top of the stack of paper sheets is thus surely pushed onto the paper sheet feeding roller 9.

Figure 2:
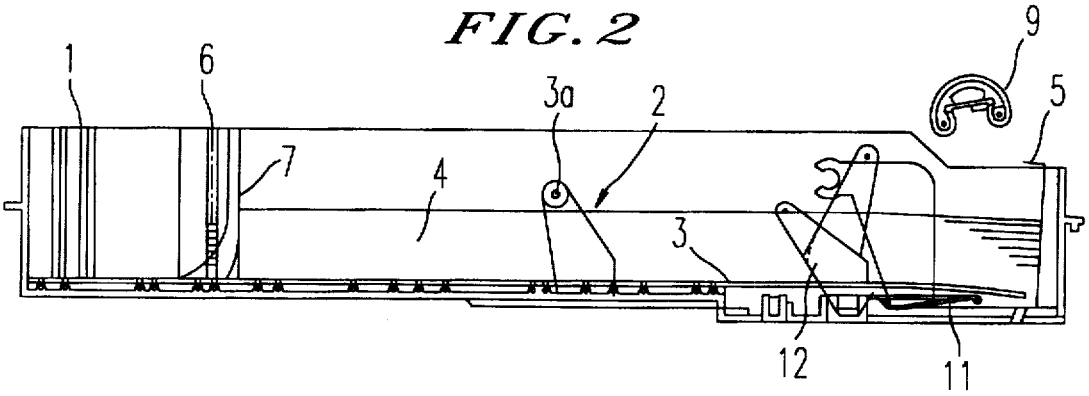
FIG. 2 is a cross sectional view showing the paper sheet feeding tray located at the lowest position with the paper sheets having been added.

If the elastic force of the pulling springs 13, 14 is properly adjusted, when the paper sheet feeding tray 1 is removed and the bottom plate lifting up mechanism 8 is released by movement of the releasing arms 15, 16 in order to supply additional paper sheets, the bottom plate 3 stops at a position where the weight of the paper sheets and the elastic force of the pulling springs 13, 14 balance. In this case there is no buckling. If more paper sheets 4 are supplied, the bottom plate 3 moves down to its lowest position by the weight of the paper sheets 4 as shown in FIG. 2 and the plate spring 7 is pushed back by the trailing edge of the paper sheets and bent toward the end fence 6. The remaining paper sheets and supplied paper sheets are thus accommodated under the same conditions in the paper accommodating portion 2. Accordingly, even when the bottom plate 3 rises again and paper sheets are fed from the paper sheet feeding apparatus, no double feeding, misfeeding or paper jam occurs and the paper sheets are picked up and fed into the image forming machine.

According to the present invention, since the bottom plate initially rises to a predetermined position when supplying paper sheets, it is easy to supply paper sheets in the paper feeding tray. If there are remaining paper sheets, they are not buckled and will not be misfed. Moreover, since the bottom plate move down to its lowest position by the weight of the supplied paper sheets, it is possible to return to the initial state of the paper feeding apparatus and to feed paper sheets in same condition as before even though the bottom plate has moved up and paper sheets have been supplied.

Additionally, it is possible to adjust the position of the bottom plate when the tension of the pulling springs is released, whereby it is possible to set suitable heights according to the weight of the paper sheets (the number of remaining paper sheets) or the elastic force of the springs.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United State is:

1. A paper sheet feeding device for receiving paper sheets from above in an image forming apparatus, comprising:

a bottom plate for supporting paper sheets;

lifting-up means for lifting up said bottom plate; and releasing means for partially releasing said lifting-up means in response to initiation of a paper adding operation such that the bottom plate assumes a raised position determined by the weight of the paper sheets thereon, whereby the bottom plate assumes a desired position during a paper adding operation.

2. The paper sheet feeding apparatus recited in claim 1, wherein said releasing means releases said lifting-up means such that said bottom plate moves to a lowest position thereof by the weight of paper sheets added.

3. The paper sheet feeding apparatus recited in claim 1, further including adjusting means for adjusting a degree of release of said lifting-up means by said releasing means.

4. The paper sheet feeding apparatus recited in claim 1, wherein said lifting-up means comprises a spring and wherein said adjusting means comprises adjusting the spring force applied by said spring.

5. A paper sheet feeding device for receiving paper sheets from above in an image forming apparatus, comprising:

a bottom plate for supporting paper sheets;

bottom plate lifting-up mechanism comprising a pressing arm in contact with said bottom plate, a pressing lever driving said pressing arm, and a pulling spring elastically urging said pressing lever; and a pressure releasing arm operative in response to initiation of a paper adding operation such that the bottom plate assumes a raised position determined by the weight of the paper sheets thereon.

6. An image forming apparatus comprising:

an image forming device; and a paper sheet feeding device in which paper sheets are supplied from above, comprising:

a bottom plate for accommodating paper sheets, lifting-up means for lifting up said bottom plate, and releasing means for partially releasing said lifting-up means in response to initiation of a paper adding operation such that the bottom plate assumes a raised position determined by the weight of the paper sheets thereon, whereby the bottom plate assumes a desired position during a paper adding operation.

7. The image forming apparatus recited in claim 6, wherein said releasing means releases said lifting-up means such that said bottom plate moves to a lowest position thereof by the weight of paper sheets added.

8. The image forming apparatus recited in claim 6, further including adjusting means for adjusting a degree of release of said lifting-up means by said releasing means.

9. A method of adding paper sheets to a paper sheet feeding device in an image forming apparatus, the paper sheet feeding device having a bottom plate which lifts the paper sheets for feeding, comprising the steps of:

drawing the paper sheet feeding apparatus out of the image forming apparatus;

partially releasing the lifting of the paper sheets by the bottom plate in response to said drawing step, such that said bottom plate assumes a raised position based on the weight of the paper sheets thereon; and adding paper sheets to said paper sheet feeding device.

10. The method feeding paper sheets recited in claim 9, further including a step permitting said bottom plate to move to a lowest position thereof in response to said adding step.

* * * * *